US005813468A

United States Patent [19]

Borak, Jr.

[11] Patent Number: 5,813,468

[45] Date of Patent: Sep. 29, 1998

[54] DUAL CASING HANGER

[75] Inventor: Eugene A. Borak, Jr., Cypress, Tex.

[73] Assignee: ABB Vetco Gray Inc., Houston, Tex.

[21] Appl. No.: 780,118

[22] Filed: Dec. 26, 1996

[51] Int. Cl.[6] ..... E21B 33/047

[52] U.S. Cl. ..... 166/368; 166/77.53; 166/75.14; 166/97.5

[58] Field of Search ..... 166/368, 77.53, 166/75.14, 52, 97.5, 313, 366

[56] References Cited

U.S. PATENT DOCUMENTS

| | | | |
|---|---|---|---|
| 3,007,719 | 11/1961 | Sherman et al. | 166/97.5 X |
| 3,011,552 | 12/1961 | Rhodes et al. | 166/97.5 X |
| 3,011,804 | 12/1961 | Burns | 166/97.5 X |
| 3,050,120 | 8/1962 | McSpadden . | |
| 3,536,342 | 10/1970 | Hull et al. . | |
| 3,603,401 | 9/1971 | Nelson et al. | 166/97.5 X |
| 5,458,199 | 10/1995 | Collins et al. . | |

*Primary Examiner*—Roger J. Schoeppel

*Attorney, Agent, or Firm*—James E. Bradley

[57] ABSTRACT

A lower casing hanger including a cylindrical block with two holes is landed on a shoulder in the bore of a wellhead housing. The first hole has shoulders that are inclined relative to the axis of the housing. The second hole is smooth and has a constant diameter. A first string of casing is run through the first hole and a C-shaped annular slips is placed around the casing. The outer surface of the slips has shoulders for engaging the shoulders on the lower casing hanger. The casing is lowered until the shoulders engage, thereby preventing further downward movement of the casing. An upper casing hanger then is placed on top of the lower casing hanger. The upper casing hanger has two holes that align with the holes in the lower casing hanger. The second hole has shoulders that mate with exterior shoulders on a second slips. A second string of casing is run through the second hole and the second slips is placed around the second casing. The assembly is lowered through the second hole until the shoulders engage to prevent further downward movement of the second casing. A gasket is placed on top of the upper casing hanger and a top plate is placed on top of the gasket for deforming the gasket against the casings.

16 Claims, 3 Drawing Sheets

DUAL CASING HANGER

TECHNICAL FIELD

This invention relates in general to oil and gas wells, and in particular to a casing hanger for hanging two strings of casing within in a single wellhead housing.

BACKGROUND ART

A typical offshore well installation comprises a single string of casing in a single well. If necessary, several wells may be located side by side in a template. Multiple wells may also be drilled within a single conductor pipe. However, conductor pipes required for wells of this nature typically have a very large diameter. Some prior art wells contain two strings of casing, each with a separate casing hanger and wellhead housing at the top of the well. Other prior art wells utilize a tubing hanger with two bores, with each section of tubing located side-by-side in each bore. U.S. Pat. No. 5,458,199 shows two wells in a conductor with a guide member at the lower end of the conductor, but an improved means for locating multiple strings of casing in a single conductor is desirable.

DISCLOSURE OF THE INVENTION

A lower casing hanger is landed on a shoulder in the bore of a wellhead housing. The lower casing hanger is a cylindrical block and has two side-by-side cylindrical holes with the diameter of the first hole being slightly larger than the diameter of the second hole. The combined diameters of the holes are designed to be the maximum allowable and still fit within the bore. The inner surface of the first hole has a plurality of large downward-facing shoulders that are transverse to the axis of the wellhead housing. The inner surface of the second hole is smooth and has a constant inner diameter.

After the lower casing hanger is landed in the bore, a first string of casing is run through the first hole to a desired depth. A slips is then placed around the casing. The slips is a C-shaped ring having a split to allow radial contraction. The outer surface of the slips has a plurality of large upward-facing shoulders for sliding engagement with the shoulders on the lower casing hanger. After the slips is placed around the casing, the casing is further lowered through the first hole until the shoulders completely engage. This causes the slips to contract and grip the casing, thereby preventing further downward movement of the casing. The weight of the casing will then be supported by the lower casing hanger.

After the casing is installed, an upper casing hanger is lowered onto the top of the lower casing hanger. The upper casing hanger is almost identical to the lower casing hanger with two holes that align with the holes in the lower casing hanger. The second hole in the upper casing hanger has a slightly larger diameter than its adjacent first hole. Like the first hole in the lower casing hanger, the inner surface of the second hole has a plurality of large downward-facing shoulders that mate with exterior shoulders on a second slips.

After the upper casing hanger is landed in the bore, a second string of casing is run through the second hole to a desired depth. The second slips is then placed around the second string of casing. After the second slips is placed around the second string of casing, they are further lowered through the second hole until the shoulders completely engage, thereby preventing the further downward movement of the second string of casing.

After the second string of casing is installed, an elastomeric gasket is lowered onto the top of the upper casing hanger. The gasket is co-extensive with the upper casing hanger. The gasket has two holes which have substantially the same diameter as the strings of casing. A metal top plate, which is preferably split into two segments, is then lowered onto the top of the gasket. Like the gasket, the top plate has two holes which conform to the strings of casing. The top plate is secured to the strings of casing by bolts which clamp the segments of the top plate together. The top plate deforms the gasket against the strings of casing and against the bore of the wellhead housing.

BEST MODE FOR CARRYING OUT THE INVENTION

Figure 2:
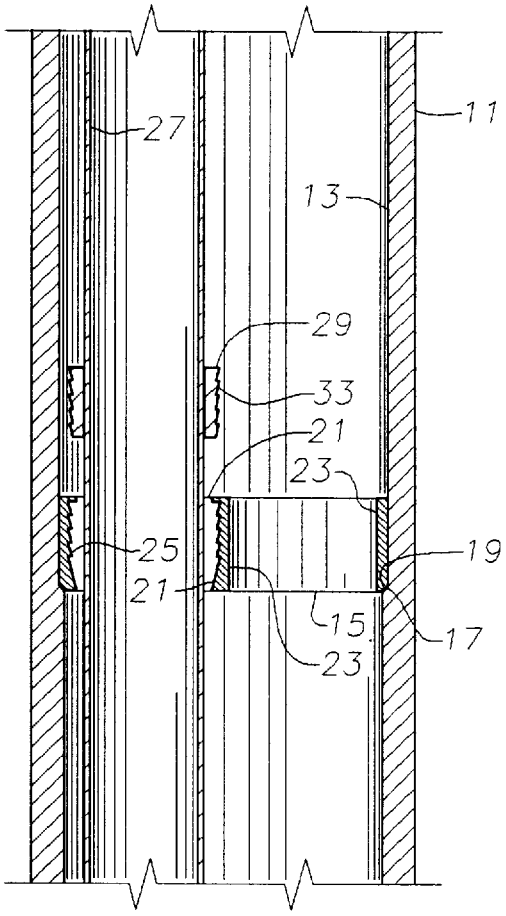
FIG. 2 is a sectional side view of the apparatus of FIG. 1 prior to landing the first string of casing.

Referring to FIG. 2, a wellhead housing 11 with a bore 13 is shown. A lower casing hanger 15 has a shoulder 17 on its lower end which lands on a load shoulder 19 in bore 13. Lower casing hanger 15 is a cylindrical block and has a diameter approximately equal to the diameter of bore 13. Lower casing hanger 15 has two side-by-side cylindrical holes 21 and 23, with the maximum diameter of hole 21 being slightly larger than the diameter of hole 23. The combined diameters of holes 21 and 23 are designed to be the maximum allowable and still fit within bore 13. The inner surface of hole 21 has a plurality of large upward-facing inclined shoulders 25 that are transverse to the axis of housing 11. Shoulders 25 are parallel to each other and at an acute angle relative to the axis of bore 13. The largest diameter of hole 21 is measured from the intersection of the uppermost shoulder 25 and shoulder 26 to the opposite side of hole 21. The inner surface of hole 23 is smooth and has a constant inner diameter.

Figure 1:
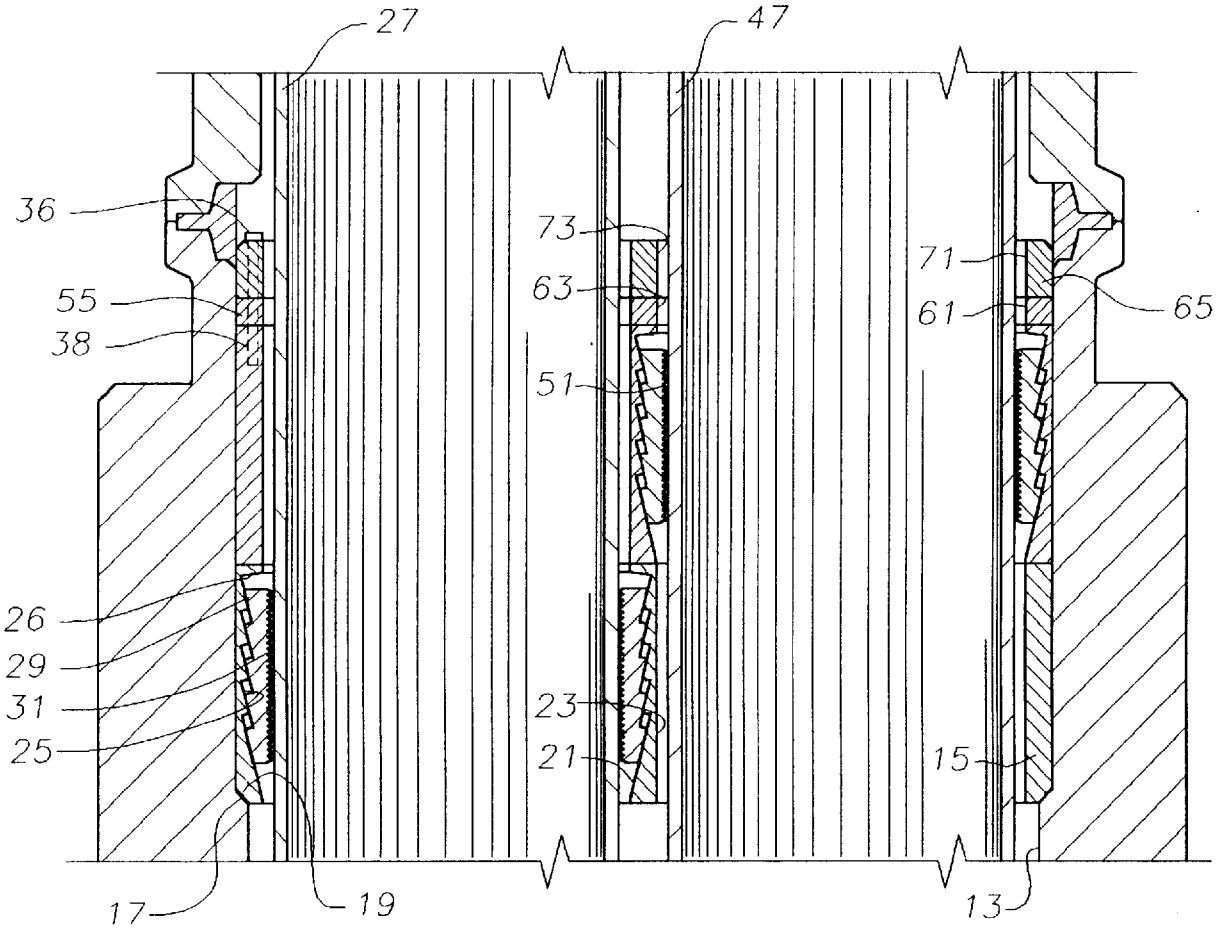
FIG. 1 is a sectional side view of the fully installed apparatus in a wellhead housing and is constructed in accordance with the invention.
Figure 3:
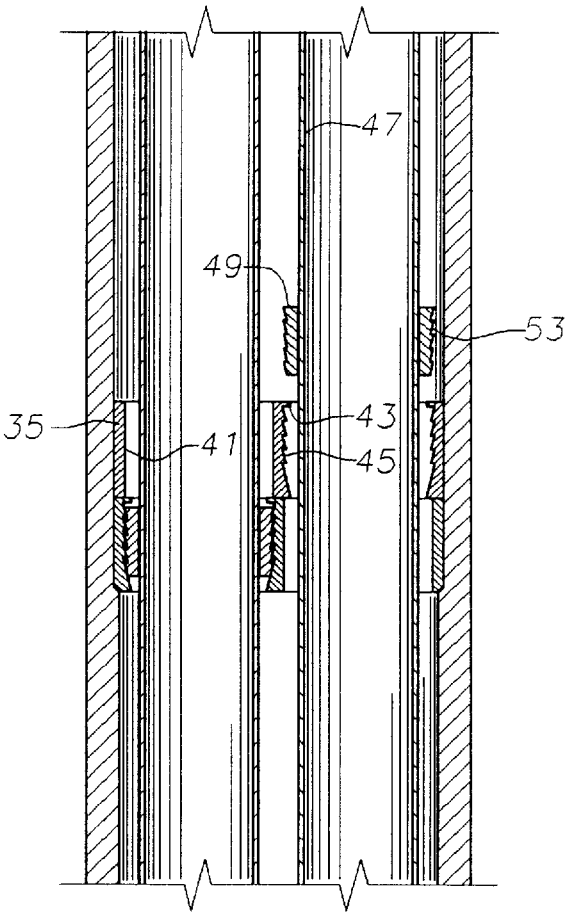
FIG. 3 is a sectional side view of the apparatus of FIG. 1 after the first string of casing is landed but prior to landing the second string of casing.
Figure 4:
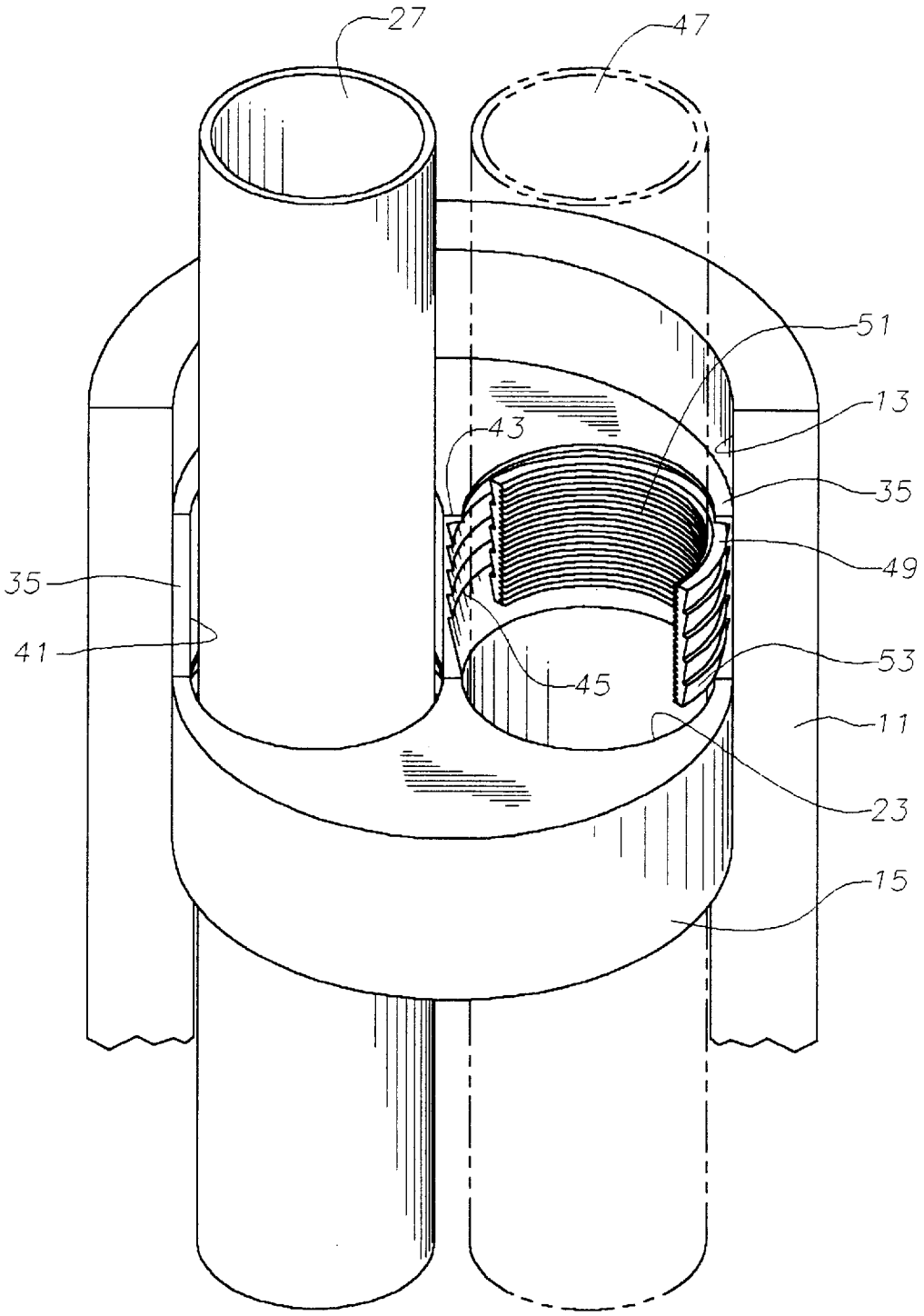
FIG. 4 is an isometric, partially-sectioned view of the of the apparatus of FIG. 1.

After lower casing hanger 15 is landed in bore 13, a first string of casing 27 is run through hole 21 to a desired depth. A slips 29 is then placed around casing 27. Slips 29 is a C-shaped ring having a split to allow radial contraction. Slips 29 has an inner diameter approximately equal to the outer diameter of casing 27. Referring to FIG. 1, the outer surface of slips 29 has a plurality of large downward-facing inclined shoulders 33 for sliding engagement with shoulders 25 on lower casing hanger 15. The inner surface of slips 29 has a plurality of small serrations 31 that are transverse to the axis of casing 27. After slips 29 is placed around casing 27 and slid down into hole 21, casing 27 is further lowered through hole 21 until shoulders 33 completely engage shoulders 25, thereby preventing the further downward movement of casing 27 (FIG. 3). Serrations 31 embed into casing 27 to prevent movement therebetween when shoulders 33 engage shoulders 25.

After casing 27 is installed, an upper casing hanger 35 is lowered onto the top of lower casing hanger 15. Like lower casing hanger 15, upper casing hanger 35 has an outer diameter approximately equal to the diameter of bore 13. Upper casing hanger 35 has two cylindrical holes 41 and 43 that align with holes 21 and 23, respectively, in lower casing hanger 15. Hole 43 has a slightly larger diameter than hole 41 and is identical to hole 21. Hole 41 is identical to hole 23. The combined diameters of holes 41 and 43 are designed to be the maximum allowable and still fit within bore 13. The inner surface of hole 43 has a plurality of large upward-facing shoulders 45 that are perpendicular to the axis of housing 11 and evenly spaced apart. The inner surface of hole 41 is smooth and slides freely over casing 27.

After upper casing hanger 35 is landed in bore 13, a second string of casing 47 is run through hole 43 to a desired depth. Casing 47 has the same outer diameter as casing 27. A slips 49 is then placed around casing 47. Like slips 29, slips 49 is a split C-shaped ring with an inner diameter approximately equal to the outer diameter of casing 47. The outer surface of slips 49 has a plurality of large downward-facing shoulders 53 for sliding engagement with shoulders 45 on upward casing hanger 35. The inner surface of slips 49 has a plurality of small serrations 51 that are perpendicular to the axis of casing 47. After slips 49 is placed around casing 47 and slid down into hole 43, casing 47 is further lowered through hole 43 until shoulders 53 completely engage shoulders 45, thereby preventing the further downward movement of casing 47 (FIG. 1). Serrations 51 embed into casing 47 to prevent movement therebetween when shoulders 53 engage shoulders 45.

After casing 47 is installed, an elastomeric gasket 55 is lowered onto the top of upper casing hanger 35. Gasket 55 has two cylindrical holes 61 and 63 which have substantially the same diameter as casings 27 and 47, respectively. A metal top plate 65, which is preferably split into two segments, is then lowered onto the top of gasket 55. Like gasket 55, top plate 65 has two holes 71 and 73 which conform to casings 27 and 47, respectively. Top plate 65 is secured to casing hanger 35 by cap screws 36 which extend downward into threaded holes 38 in casing hanger 35. Top plate 65 deforms gasket 55 against casings 27 and 47, forming a seal to wellhead housing 11.

In operation, lower casing hanger 15 is landed in wellhead housing 15. First casing string 27 is lowered through one side of lower hanger 15 to a desired depth. Slips 29 is then placed around casing 27 and landed in lower hanger 15 to prevent the further downward movement of casing 27. Next, upper casing hanger 35 slides down casing 27 and is landed on top of lower casing hanger 15. Second casing string 47 is lowered through the other side of upper casing hanger 35 to a desired depth. Slips 49 is then placed around casing 47 and landed in upper casing hanger 35 to prevent the further downward movement of casing 47. Finally, gasket 55 and top plate 65 are lowered onto the top of upper casing hanger 35 with top plate 65 deforming and sealing gasket 55 against casing strings 27 and 47 and to wellhead housing 11.

The invention has advantages. Two strings of casing may be independently hung within a single wellhead bore. The casing hanger assembly is also designed to accommodate the largest possible strings of casing.

While the invention has been shown in only one of its forms, it should be apparent to those skilled in the art that it is not so limited, but is susceptible to various changes without departing from the scope of the invention.

I claim:

1. An apparatus for hanging a first and second string of casing side-by-side in a single wellhead housing having a bore, comprising:

a lower casing hanger which lands in the bore on a shoulder, the lower casing hanger having a first hole and a second hole which are located adjacent to each other;

a first landing shoulder in the first hole;

a first slips located in the first hole on the first landing shoulder in the lower casing hanger for engaging the first string of casing to support the weight of the first string of casing;

an upper casing hanger having a first hole for receiving the first string of casing and a second hole, the upper casing hanger landing on top of the lower casing hanger;

a second landing shoulder in the second hole of the upper casing hanger; and a second slips located in the second hole on the second landing shoulder in the upper casing hanger for engaging the second string of casing to support the weight of the second string of casing.

2. The apparatus according to claim 1 wherein the second hole of the lower casing hanger and the first hole of the upper casing hanger are each cylindrical and have a constant diameter.

3. The apparatus according to claim 1 wherein the maximum diameter of the first hole of the lower casing hanger is greater than the diameter of the second hole of the lower casing hanger.

4. The apparatus according to claim 1 wherein the first hole of the lower casing hanger is substantially the same diameter as the second hole of the upper casing hanger and the second hole of the lower casing hanger is substantially the same diameter as the first hole of the upper casing hanger.

5. The apparatus according to claim 1 further comprising:

a gasket having a first hole and a second hole for the first and second strings of casing, respectively, the gasket landing on top of the upper casing hanger; and a top plate having a first hole and a second hole for the first and second strings of casing, respectively, the top plate landing on top of the gasket for deforming the gasket against the strings of casing.

6. An apparatus for hanging a first and second string of casing side-by-side in a single wellhead housing having a bore, comprising:

a lower casing hanger which lands in the bore on a shoulder, the lower casing hanger having a first hole and a second hole which are side-by-side;

a plurality of landing shoulders in the first hole;

a first slips having a plurality of external shoulders which engage the landing shoulders in the first hole and having a plurality of serrations for gripping and supporting the weight of the first string of casing;

an upper casing hanger having a first hole for receiving the first string of casing and a second hole, the upper casing hanger landing on top of the lower casing hanger;

a plurality of landing shoulders in the second hole of the upper casing hanger;

a second slips having a plurality of external shoulders which engage the landing shoulders in the second hole and having a plurality of serrations for gripping and supporting the weight of the second string of casing.

7. The apparatus according to claim 6 wherein the first hole of the upper casing hanger and the second hole of the lower casing hanger are each smooth and cylindrical and have substantially the same constant diameter.

8. The apparatus according to claim 6 wherein the maximum diameters of the first hole of the lower casing hanger and the second hole of the upper casing hanger are greater than the diameters of the second hole of the lower casing hanger and the first hole of the upper casing hanger, respectively.

9. The apparatus according to claim 6 wherein the first hole of the lower casing hanger is substantially the same diameter as the second hole of the upper casing hanger and the second hole of the lower casing hanger is substantially the same diameter as the first hole of the upper casing hanger.

10. The apparatus according to claim 6 further comprising:

a gasket having a first hole and a second hole for the first and second strings of casing, respectively, the gasket landing on top of the upper casing hanger; and a top plate having a first hole and a second hole for the first and second strings of casing, respectively, the top plate landing on top of the gasket for deforming the gasket against the strings of casing.

11. A method for hanging a first and second string of casing side-by-side in a single wellhead housing having a bore, comprising:

(a.) providing a lower casing hanger having a first hole and a second hole;

(b.) landing the lower casing hanger on a shoulder in the bore;

(c.) lowering the first string of casing through the first hole of the lower casing hanger;

(d.) placing a first slips around the first string of casing;

(e.) landing the first slips in the first hole of the lower casing hanger to prevent further downward movement of the first string of casing;

(f.) providing an upper casing hanger having a first hole and a second hole;

(g.) landing the upper casing hanger on top of the lower casing hanger with the first holes and the second holes of the casing hangers aligning;

(h.) receiving the first string of casing in the first hole of the upper casing hanger;

(i.) lowering the second string of casing into the bore and through the second holes in the first and second casing hangers to a desired depth;

(j.) placing a second slips around the second string of casing; and (k.) landing the second slips in the second hole of the upper casing hanger to prevent further downward movement of the second string of casing.

12. The method according to claim 11 wherein step (c.) occurs before steps (d.) and (e.).

13. The method according to claim 11 wherein steps (c.)–(e.) occur before step (g.).

14. The method according to claim 11 wherein step (h.) occurs simultaneously with step (g.).

15. The method according to claim 11 wherein step (i.) occurs before steps (j.) and (k.).

16. The method according to claim 11, further comprising sealing the first and second strings of casing to each other and to the wellhead housing.

* * * * *